United States Patent [19]

Lemons

[11] 4,106,651

[45] Aug. 15, 1978

[54] LEFT AND RIGHT HANDED CHILD-RESISTANT SAFETY CAP

[76] Inventor: John B. Lemons, Box 55, R.R. #2,, Dunkirk, Ind. 47336

[21] Appl. No.: 824,327

[22] Filed: Aug. 12, 1977

[51] Int. Cl.[2] ..... B65D 55/02; B65D 85/56; A61J 1/00

[52] U.S. Cl. ..... 215/221; 215/216

[58] Field of Search ..... 215/206, 216, 221

[56] References Cited

U.S. PATENT DOCUMENTS

| | | | |
|---|---|---|---|
| 3,514,003 | 5/1970 | Fitzgerald | 215/221 |
| 3,895,730 | 7/1975 | Koehne et al. | 215/221 X |

*Primary Examiner*—George T. Hall

*Attorney, Agent, or Firm*—Clarence A. O'Brien; Harvey B. Jacobson

[57] ABSTRACT

A safety closure system for containers acts to discourage children, and the like, from unscrewing a screw-on container cap, either by requiring a positive lock device associated with the cap to be first released, or by confusing the child with misleading opening instructions. The positive lock devices generally include a flap hinged to the cap and provided either with a projection or socket engageable with a mating component provided on the associated container for securing the flap, and thereby the cap, against rotation relative to the container.

8 Claims, 21 Drawing Figures

LEFT AND RIGHT HANDED CHILD-RESISTANT SAFETY CAP

BACKGROUND OF THE INVENTION

1. Field of the Invention

This invention relates generally to container closures, and more particularly to child-resistant safety closures for bottles and like containers.

2. Description of the Prior Art

A problem of great concern in recent years has been the difficulty in securing pills, such as barbiturates, household chemicals, and similar substances which may be toxic to children, and the like, against tampering by children. In view of this problem, numerous proposals have been brought forth for securing caps against opening by children, while still permitting ready opening by adults and other intended users. Examples of such safety closures can be found in U.S. Pat. Nos: 3,160,301, issued Dec. 8, 1964, to B. K. Milbourne; 3,182,840, issued May 11, 1965, to D. A. Polzin; 3,329,293, issued July 4, 1967, to D. W. Baumbach; 3,445,022, issued May 20, 1969, to F. A. Cilluffo; 3,729,110, issued Apr. 24, 1973, to C. R. Taylor; and 3,884,379, issued May 20, 1975, to W. J. Landen. All of these prior patents except U.S. Pat. No. 3,729,110 disclose arrangements wherein a projecting element provided on the cap of the container assembly engages with a socket or pawl provided on a neck portion of the container, while U.S. Pat. No. 3,729,110 discloses an arrangement wherein a latchable projection abuts a rim provided on the neck of the container to prevent cap removal.

SUMMARY OF THE INVENTION

It is an object of the present invention to provide a safety closure structure which will positively secure a screw-on cap against rotation relative to an associated container mouth on which the cap is threaded.

It is another object of the present invention to provide a safety closure for bottles and similar containers which provides a certain amount of finger dexterity to release a lock positively securing the closure to the container.

It is another object of the present invention to provide a safety closure system for containers, such as bottles, which will confuse a child, and the like, as to the proper manner of removing the closure from the associated container.

These and other objects are achieved according to the present invention by providing a safety closure structure having: a container including a mouth forming an access opening into a hollow interior of the container; a cap mountable on the mouth of the container; a retaining arrangement provided on the container and on the cap for removably holding the cap on the mouth of the container; and a lock device provided on the cap and the container for preventing removal of the cap from the container.

The cap is preferably provided with a hollow cavity having a configuration arranged for receiving the mouth of the container, with the retaining arrangement including internal screw threads provided in the cavity and cooperating with external screw threads provided on the container at the mouth thereof for engaging with the internal screw threads and holding the cap on the neck of the container. The external and internal threads either can be left-hand threads or right-hand threads as the situation warrants.

The lock device advantageously includes a flap pivotally connected to the cap and arrangeable beneath the threads provided within the cavity of the cap, as well as those provided on the container adjacent the mouth thereof, with a fastener assembly being provided on the flap and on the container for removably securing the flap to the container and preventing rotation of the cap so as to unscrew and remove the cap from the container.

The fastener assembly preferably includes a projection provided on one of the container and the flap and a socket provided in the other of the container and the flap, with the socket being arranged for removably receiving the projection with a snapaction fit.

When, for example, a left-hand thread is employed, the securing arrangement can take the form simply of a direction arrow, and possibly an associated instruction, provided on the cap which indicates the cap is to be unscrewed in a clockwise direction instead of the necessary counterclockwise direction so as to confuse a child, and the like, attempting to open the container.

These together with other objects and advantages which will become subsequently apparent reside in the details of construction and operation as more fully hereinafter described and claimed, references being had to the accompanying drawings forming a part hereof, wherein like numerals refer to like parts throughout.

DESCRIPTION OF THE PREFERRED EMBODIMENTS

Figure 1:
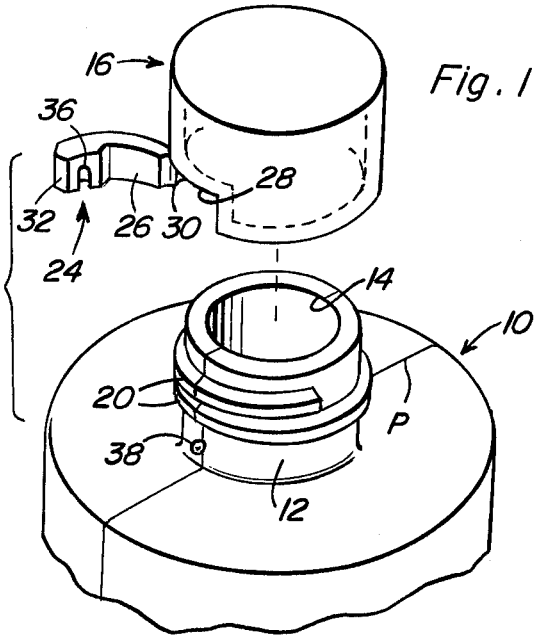
FIG. 1 is a fragmentary, exploded, perspective view showing a first embodiment of a safety closure system according to the present invention.
Figure 2:
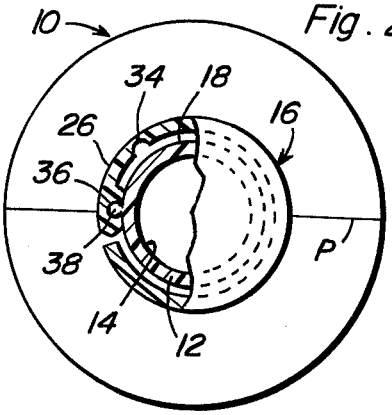
FIG. 2 is a reduced, top plan view, partly cut away and in section, showing the embodiment of the invention seen in FIG. 1.
Figure 3:
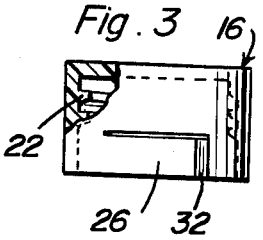
FIG. 3 is a side elevational view, partly cut away and in section, showing the cap of the embodiment of the invention seen in FIGS. 1 and 2.

Referring now more particularly to FIGS. 1 through 3 of the drawings, a container 10 is illustrated as having a mouth in the form of a neck 12 of greatly reduced diameter than that of container 10 and forming an access opening 14 into the interior of the hollow container 10. Removably mountable on neck 12 of container 10 is a cap 16 of generally cylindrical configuration and including a hollow cavity 18 having a configuration arranged for receiving neck 12 of container 10. Cap 16 is retained on neck 12 in a conventional manner as by the illustrated external screw threads 20 provided on neck 12 and which cooperate with internal screw threads 22 provided within cavity 18 of cap 16. By provision of the screw threads 20 and 22, cap 16 can normally be screwed onto and unscrewed from neck 12. Provided on neck 12 and cap 16 is a lock device 24 arrangeable for securing cap 16 against rotation relative to neck 12 and preventing removal of cap 16 from container 10.

Lock device 24 includes a flap 26 pivotally connected to cap 16 and arrangeable beneath the external screw threads 20 provided on neck 12 of container 10. Cap 16 has a generally cylindrical side wall partially forming cavity 18 and forming an opening permitting access to cavity 18, at which opening is provided in the side wall a cut out 28 arranged for receiving flap 26. The latter is provided with a pair of edge 30 and 32, edge 30 of which tapers into a reduced thickness web forming an integral hinge with respect to the side wall of cap 16 so as to pivotally connect flap 26 to cap 16. A slot-like recess is provided adjacent edge 32 of flap 26 to form a socket 36 which cooperates with a projection 38 having an enlarged head and provided on the neck 12 substantially on the parting line P of container 10 so as to secure flap 26, and therefore cap 16, to neck 12 and prevent cap 16 from being unthreaded and removed from the mouth of container 10.

Several modifications of the basic construction shown in FIGS. 1 through 3 of the drawings will now be discussed, with an appropriate number of primes being added to the reference numerals as they were applied to the embodiment shown in FIGS. 1 through 3 to designate those elements which are substantially the same as the equivalent elements of the embodiment previously discussed.

Figure 4:
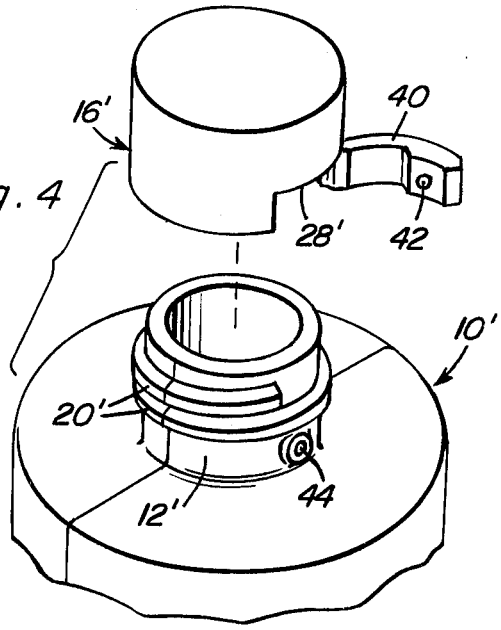
FIG. 4 is a fragmentary, exploded, perspective view, similar to FIG. 1, but showing a second embodiment of the present invention.
Figure 5:
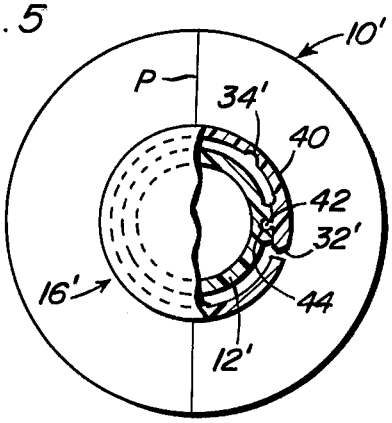
FIG. 5 is a reduced, top plan view, partly cut away and in section, similar to FIG. 2, but showing the embodiment of the invention seen in FIG. 4.

Referring now more particularly to FIGS. 4 and 5 of the drawings, a cap 16′ is provided with a flap 40 hinged thereto and having extending therefrom adjacent an edge 32′, a projection 42 which fits into a socket 44 provided on neck 12′ of a container 10′. It will be appreciated that projection 42 and socket 44 cooperate to engage with one another in a manner generally referred to as a "snap-fit", as do socket 36 and projection 38 and all the other sockets and projects of the various embodiments of the invention disclosed herein.

Figure 6:
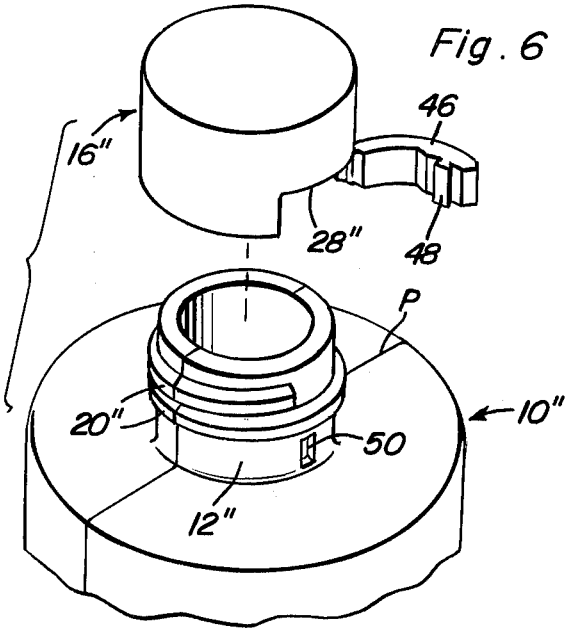
FIG. 6 is a fragmentary, exploded, perspective view, similar to FIGS. 1 and 4, but showing a third embodiment of the invention.
Figure 7:
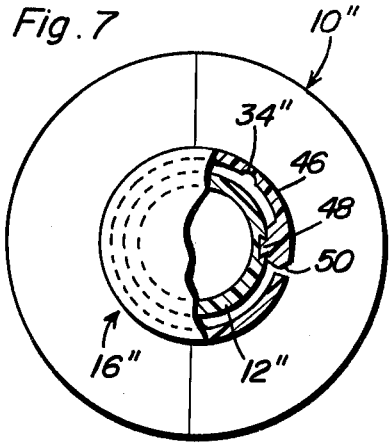
FIG. 7 is a reduced, top plan view, partly cut away and in section, similar to FIGS. 2 and 5, but showing the embodiment of the invention seen in FIG. 6.
Figure 8:
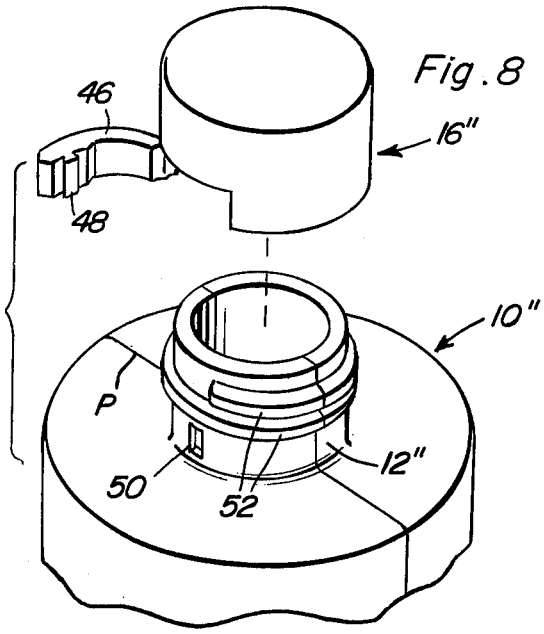
FIG. 8 is a fragmentary, exploded, perspective view, showing a fourth embodiment of the present invention.
Figure 9:
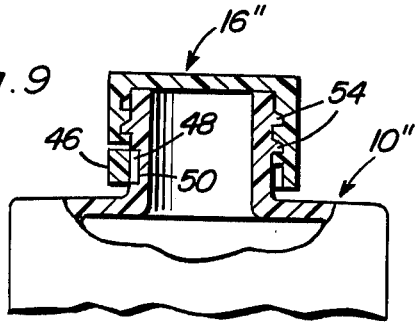
FIG. 9 is a reduced, fragmentary, side elevational view, partly cut away and in section, showing the embodiment of the invention seen in FIG. 8.

FIGS. 6 and 7 of the drawings disclose a cap 16″ including a flap 46 integrally hinged thereto and provided with a projection 48 of generally dove-tailed configuration and which cooperates with an appropriately configured socket 50 provided in neck 12″ of a container 10″. The embodiment of the invention shown in FIGS. 8 and 9 has the identical projection and socket configuration as seen in FIGS. 6 and 7, but employs left-handed screw threds 52 and 54 on neck 12′ and within the cavity of cap 16″ in order to illustrate that the direction of the screw threads employed with a safety closure system according to the present invention is not dependent on the direction of the screw threads employed.

Figure 10:
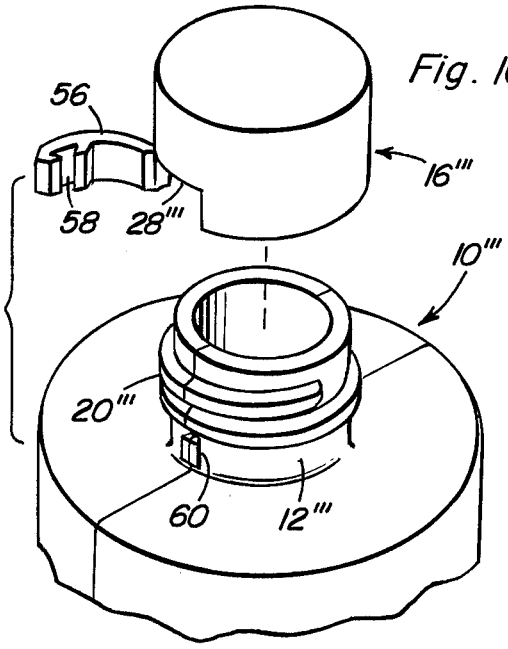
FIG. 10 is a fragmentary, exploded, perspective view, similar to FIGS. 1, 4, 6, and 8, but showing a fifth embodiment of the present invention.
Figure 11:
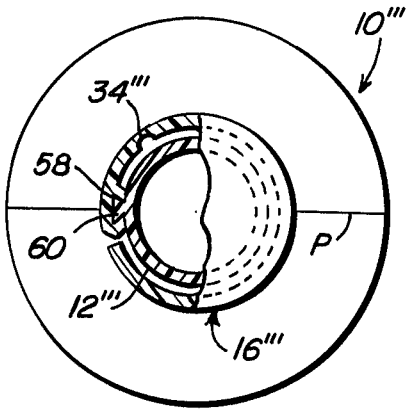
FIG. 11 is a reduced, top plan view, partly cut away and in section, similar to FIGS. 2, 5, and 7, but showing the embodiment of the invention seen in FIG. 10.

Referring now to FIGS. 10 and 11 of the drawings, yet another embodiment of the invention similar to those discussed above employs a flap 56 integrally hinged to a cap 16‴ and provided with a socket 58 of generally dove-tailed configuration for receiving in "snap-action" manner a dove-tailed projection 60 provided on neck 12‴ of container 10‴. Thus, the embodiment illustrated in FIGS. 10 and 11 is essentially the same as those illustrated in FIGS. 6 through 9, but with the socket and projection reversed.

Figure 12:
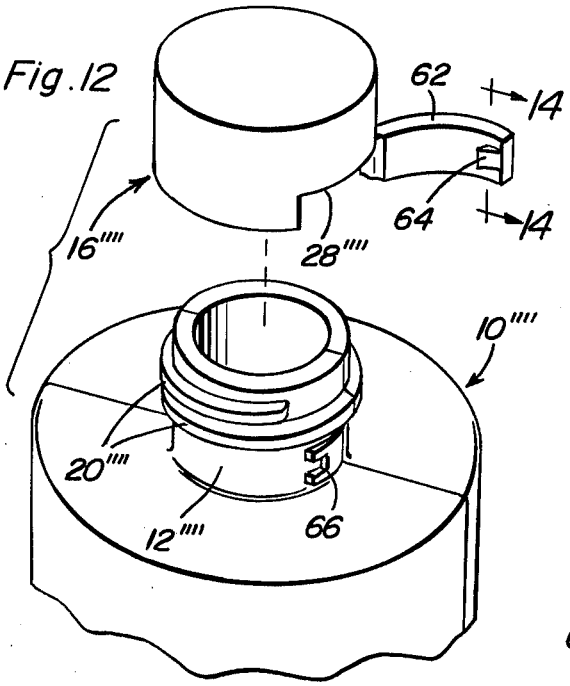
FIG. 12 is a fragmentary, exploded, perspective view, showing a sixth embodiment of the present invention.
Figure 13:
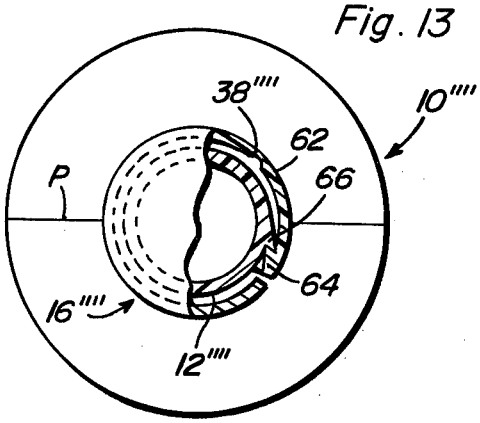
FIG. 13 is a reduced, top plan view, partly cut away and in section, similar to FIGS. 2, 5, 7, and 11, but showing the embodiment of the invention seen in FIG. 12.
Figure 14:
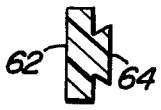
FIG. 14 is a sectional view taken generally along the line 14—14 of FIG. 12.

FIGS. 12 through 14 show yet another embodiment of the invention employing an integrally hinged flap 62 which swings sidewards relative to a cap 16⁗ and neck 12⁗ and is provided with a generally wedge-shaped projection 64 which engages in a matching socket 66 provided on neck 12⁗ of container 10⁗ to prevent unwanted rotation of cap 16⁗ when same is screwed onto the external threads 20⁗ provided on neck 12⁗.

Figure 15:
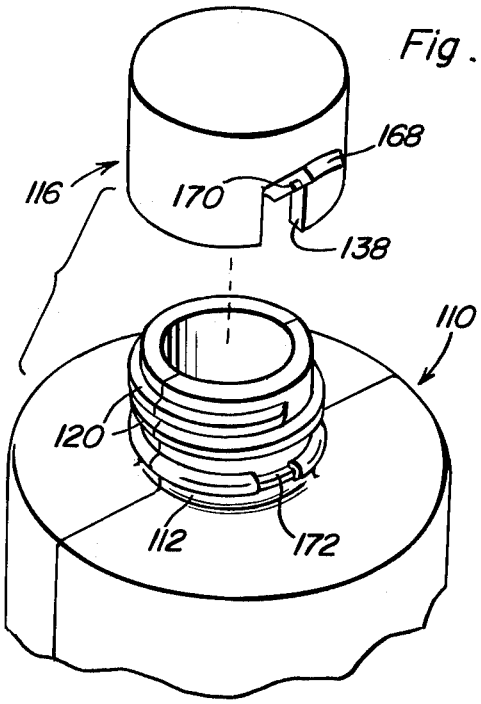
FIG. 15 is a fragmentary, exploded, perspective view, showing yet another embodiment of the present invention.
Figure 16:
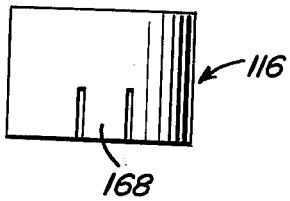
FIG. 16 is a side elevational view showing the cap of the embodiment of the invention seen in FIG. 15.
Figure 17:
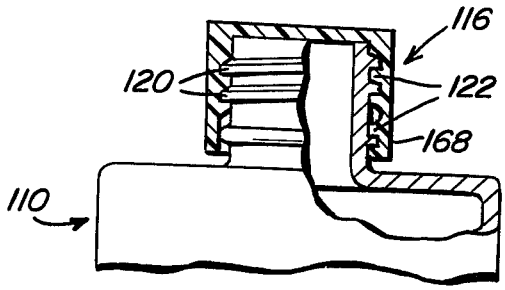
FIG. 17 is a side elevational view, partly cut away and in section, showing the embodiment of the invention seen in FIG. 15.

Moving along now to the embodiment of the invention illustrated in FIGS. 15, 16, and 17 of the drawings, a slightly different approach is taken compared to the embodiments discussed above, inasmuch as a flap 168 is integrally hinged to an associated cap 116 for vertical swinging movement as opposed to the horizontal swinging movement of the previous embodiments. This flap 168 is provided with a socket 170 generally in the form of a longitudinal slot extending substantially parallel to the hinge line of flap 168 and engageable with a projection 172 in the form of a length of the thread 120 of reduced cross section in order to restrain cap 116 from rotation relative to neck 112 of the associated container 110.

Figure 18:
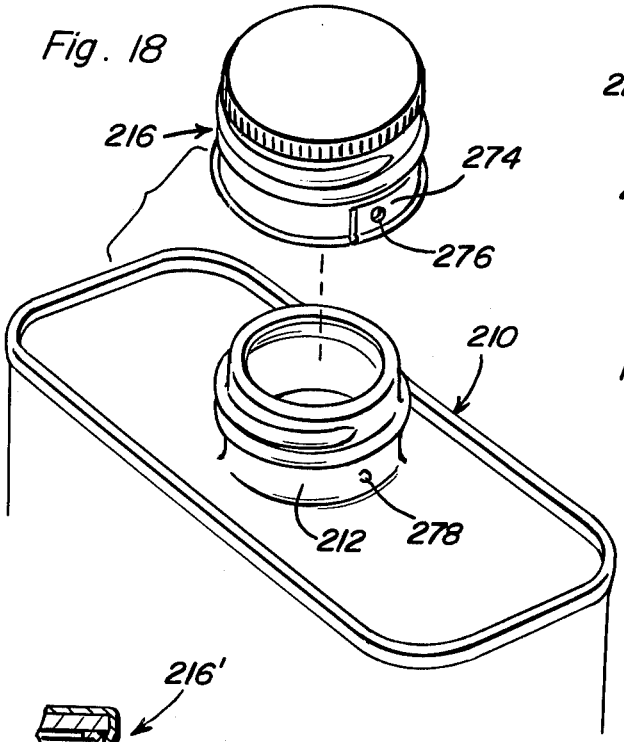
FIG. 18 is a fragmentary, exploded, perspective view showing a still further embodiment of the present invention.
Figure 19:
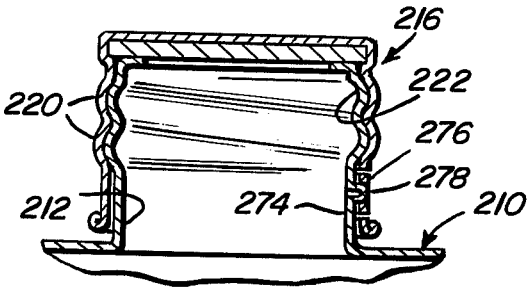
FIG. 19 is an enlarged, fragmentary, vertical cross-sectional view taken through the embodiment of the invention seen in FIG. 18.
Figure 20:
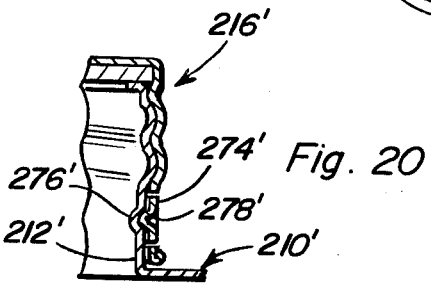
FIG. 20 is a fragmentary, cross-sectional view similar to the right-hand portion of FIG. 19, but showing a modification of the embodiment of the invention seen in FIGS. 18 and 19.

FIGS. 18 and 19 disclose the use of the flap-lock according to the invention in conjunction with a metal-form of container 210 provided with a stamped sheet-metal cap 216. The flap 274 is simply cut into the lower portion of cap 216 and in the form shown in FIGS. 18 and 19 is provided with an aperture forming a socket 276 which is selectively engaged by an enlarged head projection 278 provided on neck 212 of container 210. FIG. 20 shows a modification of the arrangement shown in FIGS. 18 and 19, inasmuch as the projection 278 is a dimple directed inwardly from the surface of a flap 274 so as to engage with a mating dimple designated 276' and formed on the surface of neck 212' of container 210'.

As will be noted from a study of the figures discussed above, although the projection 38 is illustrated in FIGS. 1 and 2 as being directly on the parting line P of the associated container 10, the projections and sockets of the other illustrated embodiments of the invention are generally arranged perpendicularly to the parting line P with the exception of the embodiment illustrated in FIGS. 10 and 11 of the drawings which has the projection and socket disposed on parting line P, and the embodiment shown in FIGS. 12 through 14, wherein the wedge-shaped arrangement is offset from parting line P, for example, 20 degrees. The embodiments illustrated in FIGS. 18 through 20 of the drawings are not constructed with such parting lines. While it is to be understood that the length of the flap in those embodiments in which the flap swings in a horizontal plane, or parallel to the mouth of the container, the flap can extend for, for example, approximately 50° of arc around the circumference of the associated cap. The relationship of the flap, projection, and socket of the lock devices according to the invention relative to the parting line of those containers which are, for example, injection molded, relates to the feasibility of so constructing the various embodiments of the invention.

Figure 21:
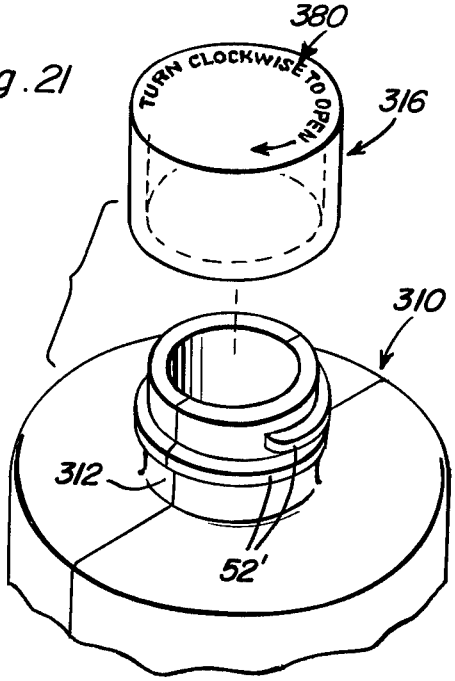
FIG. 21 is a fragmentary, exploded, perspective view showing an embodiment of the present invention wherein confusing instructions are employed to make difficult the removal of the cap from the container.

FIG. 21 discloses an embodiment of the invention wherein opening of a container 310 is hindered by misleading instructions as represented by the indicia 380 provided on the top of a cap 316. It will be noted that this embodiment of the invention has left-handed screw threads 52' provided on the neck 312 of container 310 such that the cap 316 must be rotated in a counterclockwise direction to be unscrewed from neck 312. By deliberately indicating on cap 316, as by indicia 380, that the cap is to be rotated in the clockwise direction to open same, such clockwise rotation will only tighten cap 316 on the associated container 310.

As can be readily understood from the above description and from the drawings, a safety closure system according to the present invention permits a simple and inexpensive manner closure such as bottle and vial screw caps to be retained on their associated containers in such a manner as to hinder opening of the containers by children, and the like, while readily permitting adults to unlock the closures and remove same from the associated containers for access to the contents of the containers.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A safety closure structure for containers, comprising, in combination:

a. a hollow container having a mouth forming an access opening into the container;

b. a cap removably mountable on the mouth of the container for blocking the access opening; and c. lock means provided on the cap and the container for preventing removal of the cap from the mouth of the container, the cap being provided with a hollow cavity having a configuration arranged for receiving the mouth of the container, with the cap including an internal screw thread provided in the cavity and the mouth provided with an external screw thread provided on the container for engaging with the internal screw thread and holding the cap on the container, the clock means including, in combination:

1. flap means pivotally connected to the cap and arrangeable beneath the external thread provided on the container adjacent the mouth thereof; and 2. fastener means provided on the flap and on the container for securing the flap to the container and preventing the cap from rotation relative to the container, the cap having a side wall partially forming the cavity and an opening communicating with the cavity, and a cut out being provided in the side wall of the cap adjacent the opening therein and arranged for receiving the flap, the latter extending between a pair of spaced, substantially parallel edges, the flap being pivotally connected to the cap at one of the edges, and a portion of the fastener means being provided on the flap adjacent the other of the edges of the flap.

2. A structure as defined in claim 1, wherein the external threads and the internal threads are one of left-hand threads and right-hand threads.

3. A safety closure structure for containers, comprising, in combination:

a. a hollow container having a mouth forming an access opening into the container;

b. a cap removably mountable on the mouth of the container for preventing removal of the cap from the mouth of the container, the cap being provided with a hollow cavity having a configuration arranged for receiving the mouth of the container, with the cap including internal screw threads provided in the cavity and the mouth provided with external screw threads provided on the container for engaging with the internal screw threads and holding the cap on the container, the lock means including, in combination:

1. a flap means pivotally connected to the cap and arrangeable beneath the external threads provided on the container adjacent the mouth thereof; and 2. fastener means provided on the flap and on the container for securing the flap to the container and preventing the cap from rotation relative to the container, the cap having a side wall partially forming the cavity and an opening communicating with the cavity, and a cut out being provided in the side wall of the cap adjacent the opening therein and arranged for receiving the flap, the latter extending between a pair of spaced, substantially parallel edges, the flap being pivotally connected to the cap at one of the edges, and a portion of the fastener means being provided on the flap adjacent the other of the edges of the flap.

4. A safety closure structure for containers, comprising, in combination:

a. a hollow container having a mouth forming an access opening into the container;

b. a cap removably mountable on the mouth of the container for blocking the access opening; and c. lock means provided on the cap and the container for preventing removal of the cap from the mouth of the container, the cap being provided with a hollow cavity having a configuration arranged for receiving the mouth of the container, with the cap including internal screw threads provided in the cavity and the mouth provided with external screw threads provided on the container for engaging with the internal screw threads and holding the cap on the container, the lock means including, in combination:

1. flap means pivotally connected to the cap and arrangeable beneath the external threads provided on the container adjacent the mouth thereof; and 2. fastener means provided on the flap and on the container for securing the flap to the container and preventing the cap from rotation relative to the container, the fastener means including a projection provided on one of the container and the flap, and a socket provided in the other of the container and the flap, the socket being arranged to removably receive the projection with a snap-action fit, the cap having a side wall partially forming a cavity of the cap, and an opening permitting communication with the cavity, and a cut out being provided in the side wall of the cap adjacent the opening thereof and arranged for receiving the flap, the flap extending between a pair of spaced, substantially parallel edges, the flap being pivotally connected to the cap at one of the edges thereof, and one of the projection and socket being provided on the flap adjacent the other of the edges of the flap.

5. A structure as defined in claim 3, wherein the pivotal connection of the flap to the cap comprises a hinge integral with the flap and cap.

6. A safety closure, comprising, in combination:

a. a cap removably mountable on a container over a mouth of the container for blocking the mouth of the container; and b. security means provided on the cap for hindering removal of the cap from the container, the cap including screw threads engageable with threads provided on the associated container for retaining the cap on the container, the security means comprising indicia provided on the cap for indicating a direction of rotation of the cap for removing same from the container which is opposite to the direction in which the cap must be rotated to be removed from the container.

7. A structure as defined in claim 4, wherein the external threads and the internal threads are one of left-hand threads and right-hand threads.

8. A structure as defined in claim 3, wherein the pivotal connection of the flap to the cap comprises a hinge integral with the flap and cap.

* * * * *